US008203587B2

(12) United States Patent
Mikami et al.

(10) Patent No.: US 8,203,587 B2
(45) Date of Patent: Jun. 19, 2012

(54) IMAGE FORMATION DEVICE

(75) Inventors: Masato Mikami, Kanagawa (JP); Sou Morizaki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 575 days.

(21) Appl. No.: 12/243,317

(22) Filed: Oct. 1, 2008

(65) Prior Publication Data

US 2009/0220272 A1 Sep. 3, 2009

(30) Foreign Application Priority Data

Mar. 3, 2008 (JP) ..... 2008-51974

(51) Int. Cl.
*B41J 27/00* (2006.01)
*B41J 2/435* (2006.01)

(52) U.S. Cl. ..... 347/242; 347/257; 347/263

(58) Field of Classification Search ..... 347/242, 347/263, 257
See application file for complete search history.

(56) References Cited

U.S. PATENT DOCUMENTS

| | | | | |
|---|---|---|---|---|
| 5,340,252 | A * | 8/1994 | Weddendorf | 411/267 |
| 5,668,588 | A * | 9/1997 | Morizumi et al. | 347/242 |
| 6,394,568 | B1 * | 5/2002 | Menendez | 347/8 |
| 2002/0051049 | A1 * | 5/2002 | Hiyoshi | 347/130 |
| 2003/0043252 | A1 * | 3/2003 | Kerr et al. | 347/224 |
| 2007/0126852 | A1 * | 6/2007 | Fukutome et al. | 347/262 |

FOREIGN PATENT DOCUMENTS

| | | | |
|---|---|---|---|
| JP | U-60-53556 | | 4/1985 |
| JP | U-62-74204 | | 5/1987 |
| JP | A-5-84974 | | 4/1993 |
| JP | A-8-114214 | | 5/1996 |
| JP | 10122222 | A * | 5/1998 |
| JP | A-10-122222 | | 5/1998 |
| JP | A-2002-014524 | | 1/2002 |
| JP | A-2002-137438 | | 5/2002 |
| JP | A-2003-308936 | | 10/2003 |
| JP | A-2005-014497 | | 1/2005 |
| JP | A-2005 186367 | | 7/2005 |
| JP | A-2005-335074 | | 12/2005 |
| JP | A-2006-84636 | | 3/2006 |
| JP | B2-3790132 | | 6/2006 |

OTHER PUBLICATIONS

Jan. 26, 2010 Office Action issued in Japanese Patent Application No. 2008-051974 (with translation).

* cited by examiner

*Primary Examiner* — Stephen Meier
*Assistant Examiner* — Sarah Al Hashimi
(74) *Attorney, Agent, or Firm* — Oliff & Berridge, PLC

(57) ABSTRACT

An image formation device, which includes: an exposure head in which a screw having an axis directed to a focus direction for a photoreceptor is fixed in the vicinity of each side of the exposure head; a housing to which the exposure head is attached; a nut attached to the screw; a fixing member that limits movement of the nut with respect to the housing; and an elastic member that elastically supports the exposure head against the housing in the vicinity of the screw in the focus direction for the photoreceptor and a sub-scanning direction, in which the exposure head is moved, by rotation of the nut, in the focus direction against an elastic force by the elastic member, and a position of the exposure head with respect to the photoreceptor is adjustable in the focus direction.

6 Claims, 6 Drawing Sheets

IMAGE FORMATION DEVICE

CROSS-REFERENCE TO RELATED APPLICATION

This application is based on and claims priority under 35 USC 119 from Japanese Patent Application No. 2008-51974 filed on Mar. 3, 2008.

BACKGROUND

1. Technical Field

The present invention relates to an image formation device.

2. Related Art

In an electrophotographic-type image formation device, LPHs (Led Print Head) are employed as a typical exposure head for exposure on a photoreceptor. In a case where the LPH is installed in the image formation device, in general, a reference for determining a focus position of both ends of the LPH is adjusted to a target position in advance, and the focus position is determined by contacting the reference with the supporting section of the image formation device by moving the reference in a focus direction until it stops.

SUMMARY

An aspect of the present invention provides an image formation device, which includes: an exposure head in which a screw having an axis directed to a focus direction for a photoreceptor is fixed in the vicinity of each side of the exposure head; a housing to which the exposure head is attached; a nut attached to the screw; a fixing member that limits movement of the nut with respect to the housing; and an elastic member that elastically supports the exposure head against the housing in the vicinity of the screw in the focus direction for the photoreceptor and a sub-scanning direction, in which the exposure head is moved, by rotation of the nut, in the focus direction against an elastic force by the elastic member, and a position of the exposure head with respect to the photoreceptor is adjustable in the focus direction.

BRIEF DESCRIPTION OF THE DRAWINGS

An exemplary embodiment of the present invention will be described in detail based on the following figures, wherein.

DETAILED DESCRIPTION

Referring now to the accompanying drawings, a detailed description will be made of an example of the present invention.

First, with reference to FIGS. 1A and 1B, a description will be made of a portion where an exposure head that forms an electrostatic latent image on a photoreceptor 7 is installed in an image formation device 50.

Figure 1B:
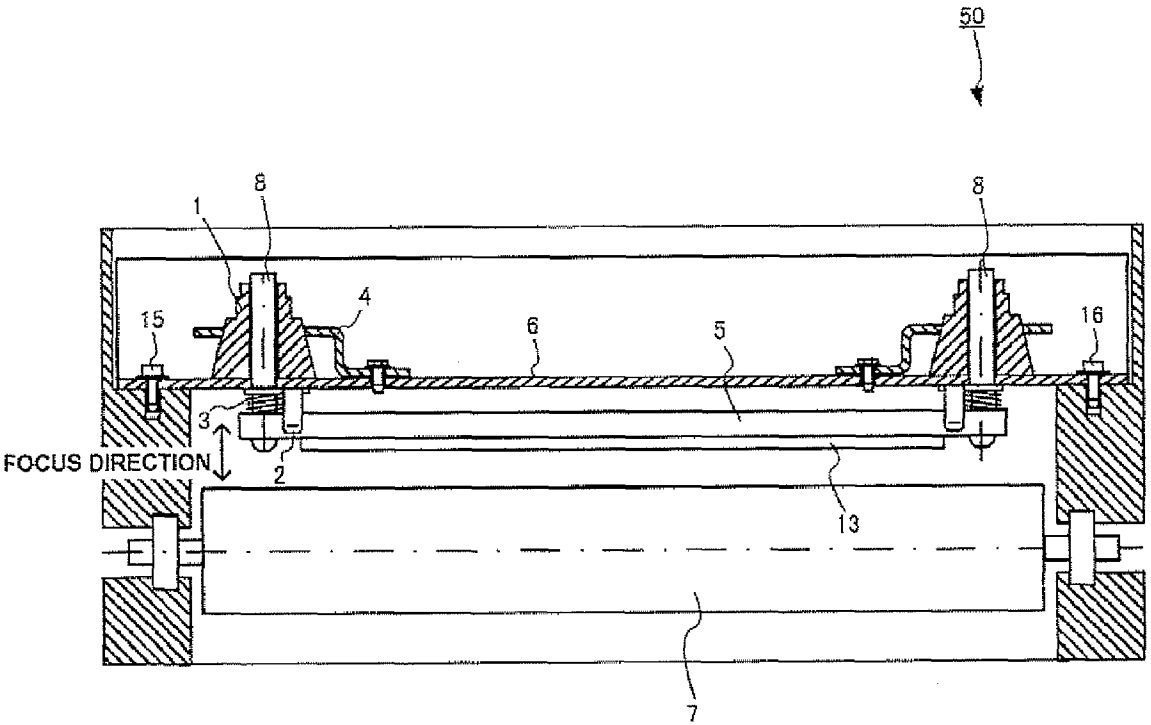
FIGS. 1A and 1B are schematic views showing a configuration of portion where an exposure head of an image formation device is attached.
Figure 1A:
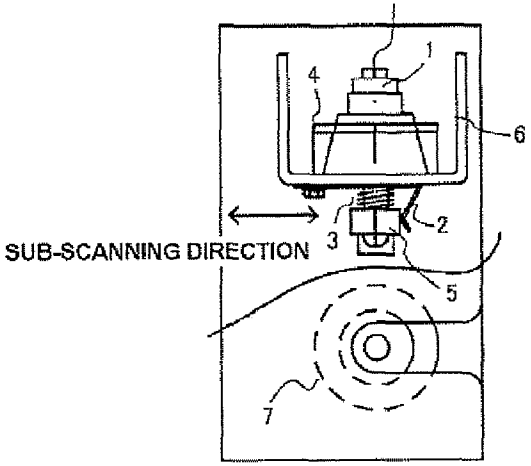

FIGS. 1A and 1B are schematic views showing a configuration of a portion where the exposure head of the image formation device 50 is installed, FIG. 1A is a configuration diagram showing a side view in which the exposure head is fixed to a housing 6, and FIG. 1B is a configuration diagram showing a front view in which the exposure head is fixed to the housing 6.

As shown in FIG. 1B, an LPH is employed for the exposure head that performs exposure on the photoreceptor in the image formation device 50.

A configuration around the exposure head is formed by a special nut 1, a plate spring 2, a coil spring 3, a nut fixing member 4, an LPH (5), a housing 6, and a photoreceptor 7.

The LPH (5) is an exposure device that forms an electrostatic latent image by performing exposure on the photoreceptor 7.

The photoreceptor 7 has a cylindrical shape. Toner to be transferred to a paper sheet is drawn to the electrostatic latent image formed by the LPH (5). Then, the toner attached on the photoreceptor 7 is transferred to the paper sheet by a transfer unit, which is not shown, whereby image formation on the paper sheet is performed.

Figure 2:
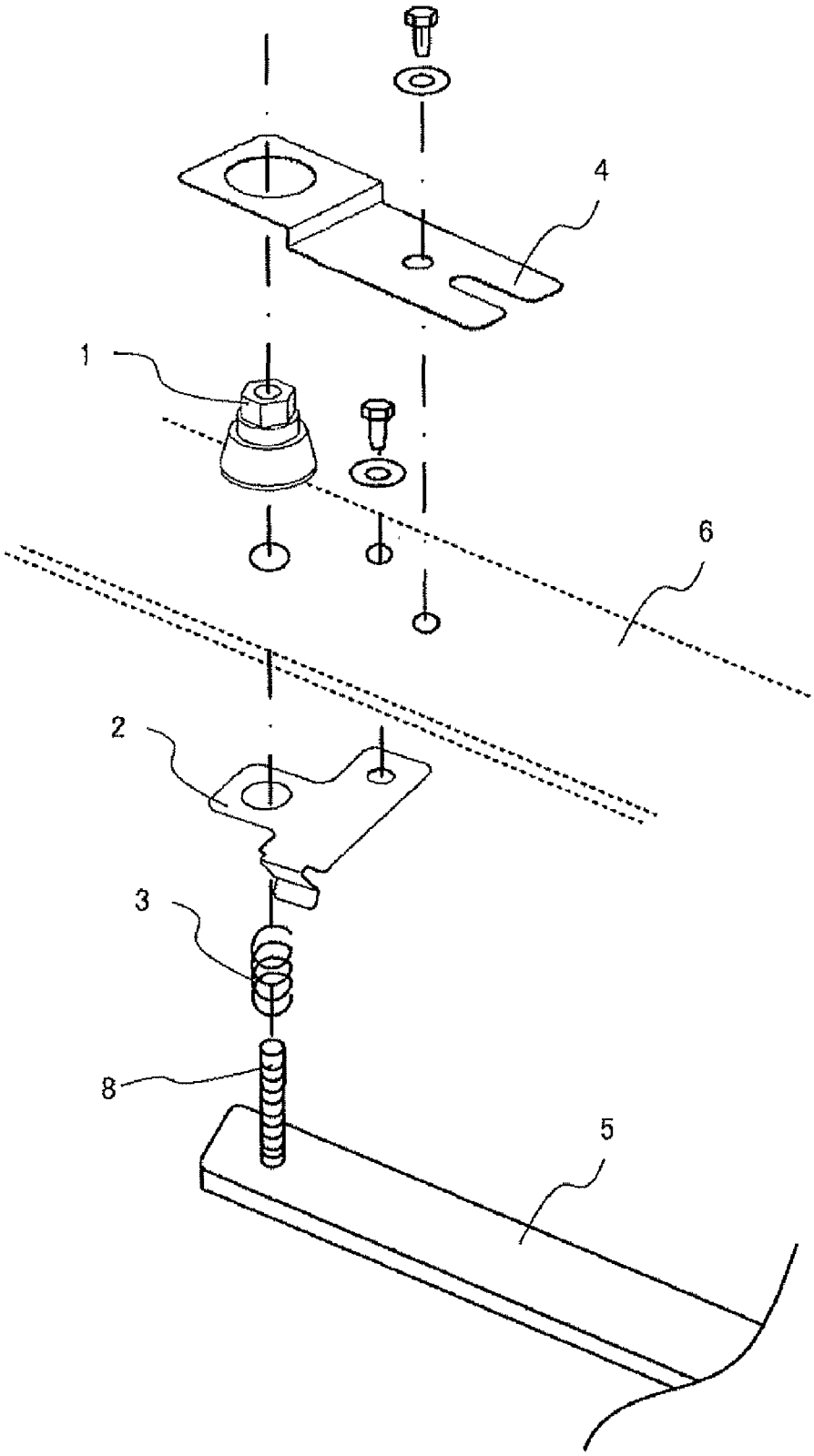
FIG. 2 is a parts-assembling diagram showing one of the portions where the exposure head is attached.

FIG. 2 is a parts-assembling diagram showing one of the portions where the exposure head is installed.

As shown in FIGS. 1B and 2, a screw 8 is fixedly provided to both ends of a rear side of a light emission surface 13 of the LPH (5). After being inserted through a coil spring 3 and a plate spring 2, the screw 8 is inserted through a hole in the housing 6 made of a sheet metal, and then the special nut is attached to the screw 8.

Then, as shown in FIG. 1B, the coil spring 3 and the plate spring 2 are placed between the LPH (5) and the housing 6.

The plate spring 2 presses the LPH (5) in a sub-scanning direction, and elastically supports the LPH (5) in the sub-scanning direction.

Additionally, the coil spring 3 presses the LPH (5) in a focus direction, which is a direction of the photoreceptor 7, and elastically supports the LPH (5) in the focus direction.

As shown in FIGS. 1A and 2, the special nut I has a conically shaped portion sloped with respect to a rotation axis of the special nut 1, and the sloped portion of the special nut 1 is fitted with a hole of the nut fixing member 4. The nut fixing member 4 whose hole is fitted with the sloped portion of the special nut 1 is screwed to the housing, as shown in FIGS. 1B and 2. The nut fixing member 4 serves as a plate spring; elastically supports the special nut 1 in the focus direction by pressing it against the housing 6; and limits the movement of the special nut 1 in the main-scanning and sub-scanning directions to fix.

There is a slight degree of freedom in a portion where the screw 8 and the special nut 1 are fitted each other Thus, the LPH (5) can be fixed without being deformed when adjustment is made to fix the LPH (5) to the housing 6.

Figure 3A:
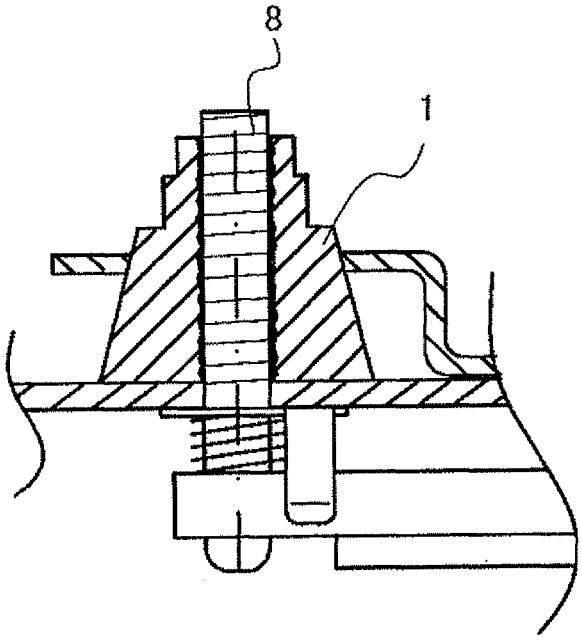
FIGS. 3A and 3B are schematic diagrams showing a special nut 1 in which an interior diameter is formed with two-step structure.
Figure 3B:
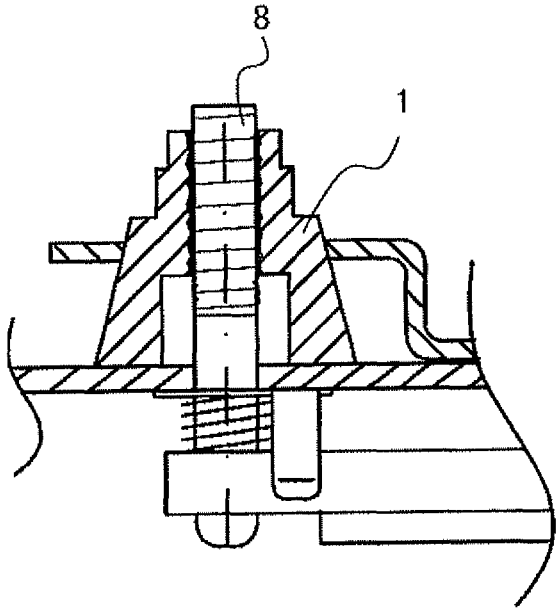

The degree of freedom in the fitting portion between the screw 8 and the special nut 1 becomes larger as the length of the engaged portion becomes shorter. Thus, it may be possible to employ a configuration in which the length of the threaded portion in the interior of the special nut 1 is made shorter to increase the degree of freedom in the fitting portion between the screw 8 and the special screw 1. For example, as shown in FIGS. 3A and 3B, the interior of the special nut 1 may be formed with two-step structure including a female thread portion and a hole portion whose diameter is larger than the female thread portion to increase the degree of freedom in the fitting portion between the screw 8 and the special screw 1. FIG. 3A is a configuration diagram showing the interior of the special nut 1, and FIG. 3B is a configuration diagram showing the special nut 1 whose interior is formed with the two-step structure. As shown in FIG. 3B, the interior of the special nut 1 may be formed with the two-step structure including the female thread portion and the hole portion whose diameter is larger than the female thread portion. In the case where the interior of the special nut 1 is formed with the two-step structure having the female thread portion and the hole portion whose diameter is larger than the female thread portion, the screw 8, as shown in FIG. 3B, has a male thread shape in a portion engaging with the female thread of the special nut 1, and a straight shape in a portion engaging with the housing 6.

As described above, since the degree of freedom is provided in the fitting portion between the screw 8 and the special nut 1, the LPH (5) is instable in the main-scanning direction, the sub-scanning direction, etc. Then, by using the plate spring 2, the coil spring 3, and the nut fixing member 4, the LPH (5) is made stably fixed to the housing 6.

The plate spring 2 presses the LPH (5) in the sub-scanning direction to stabilize the LPH (5). The coil spring 3 presses the LPH (5) in the focus direction to stabilize the LPH (5). The nut fixing member 4 fixes the special nut 1 and stabilizes the screw 8 of the LPH (5) in the main-scanning and the sub-scanning directions, thereby stabilizing the LPH (5) in the main-scanning and the sub-scanning directions.

Figure 4A:
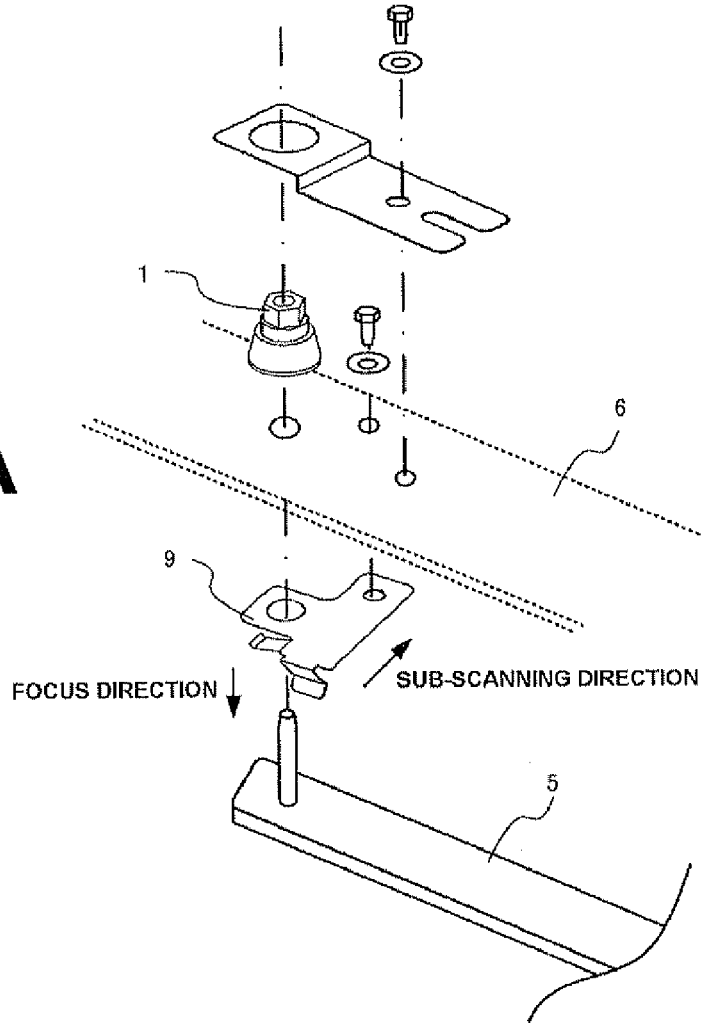
FIGS. 4A and 4B are parts-assembling diagrams showing the portion where the exposure head is attached in a case where a plate spring 9 is employed.
Figure 4B:
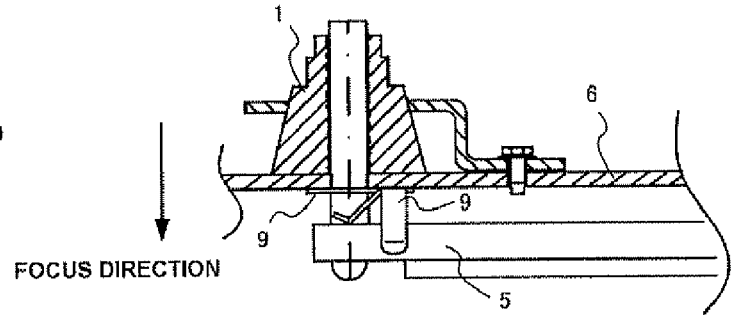

It should be noted that two springs, namely, the plate spring 2 and the coil spring 3, are not necessarily used for stabilizing the LPH (5), and a single plate spring 9 as shown in FIG. 4A may be employed.

FIG. 4A is a parts-assembling diagram showing an exposure-head-attached portion where the exposure head is fixed by using the plate spring 9.

The plate spring 9 is attached between the LPH (5) and the housing 6, and elastically supports the LPH (5) in the sub-scanning and focus directions by using a two-direction spring of the plate spring 9 for stabilizing.

Since the photoreceptor 7 is located immediately below the LPH (5) fixed to the housing 6 in the exposing direction of the LPH (5), the LPH (5) is fixed to the housing 6 so as not to protrude further out than the focusing point toward the photoreceptor 7.

As discussed above, the LPH (5) is fixed to the housing 6 at the rear side of the LPH (5) (opposite to the photoreceptor side) at a height away from the focusing point as shown in FIG. 1B. However, the LPH (5) is fixed so as not to wobble, whereby the stable imaging position in the main-scanning and the sub-scanning directions can be secured.

Next, adjustment of focus of the LPH (5) will be described. After the LPH (5) is attached to the housing 6, the focus of the LPH (5) is adjusted by rotating the special nut 1 to move up and down the LPH (5) against the elastic force of the spring 3 in the focus direction. Here, the top surface of the special nut 1 has a hexagonal shape as shown in FIG. 2, and is configured to be rotated by using such tool as a wrench. With this configuration, the focus of the LPH (5) can be adjusted while the LPH (5) remains attached to the housing 6, and only one direction, which is a direction from the rear side of the housing 6, is necessary for access to adjust the focus. Additionally, operability at the time of adjusting the focus becomes improved because there are no parts required to be detached or loosened during the adjustment.

To obtain better images, adjustment of rotating the special nut 1 and printing out of a test chart to check the adjustment result may be alternately repeated.

Alternatively, since the housing 6 equipped with the LPH (5) can be detached as the exposure device from the image formation device 50 as shown in FIGS. 1A and 1B, the focus may be adjusted in a state of being detached from the image formation device 50. The housing 6 is installed by contacting to both flank portions of the photoreceptor 7 or the surface of the photoreceptor 7. In FIGS. 1A and 1B, by removing screws 15, 16 that screw the housing 6 to fix, the housing 6 equipped with the LPH (5) can be detached from the image formation device 50. Then, after the focus of the LPH (5) attached to the housing 6 is adjusted in this state, the housing 6 equipped with the adjusted LPH (5) is attached back to the image formation device 50. The focus adjustment of the LPH (5) within the housing 6 may be made by mechanically matching a height of round protrusions provided on both ends of the LPH (5) with a height of an exposure-device-receiving portion of the image formation device 50 as the reference, or by optically focusing the LED (Light Emitting Diode) light emitted from the LPH (5). It should be noted that, by adjusting the focus in a state of being attached to the housing, the LPH (5) has a shape not protruding further out than this focusing point toward the photoreceptor 7.

It should be noted that, since the nut fixing member 4 has a simple structure, the focus can be adjusted by rotating the special nut 1 white the nut fixing member 4 remains attached to the housing 6.

Next, with reference to FIG. 5, a nut fixing member different from the nut fixing member 4 as shown in FIGS. 1A and 1B will be described.

Figure 5:
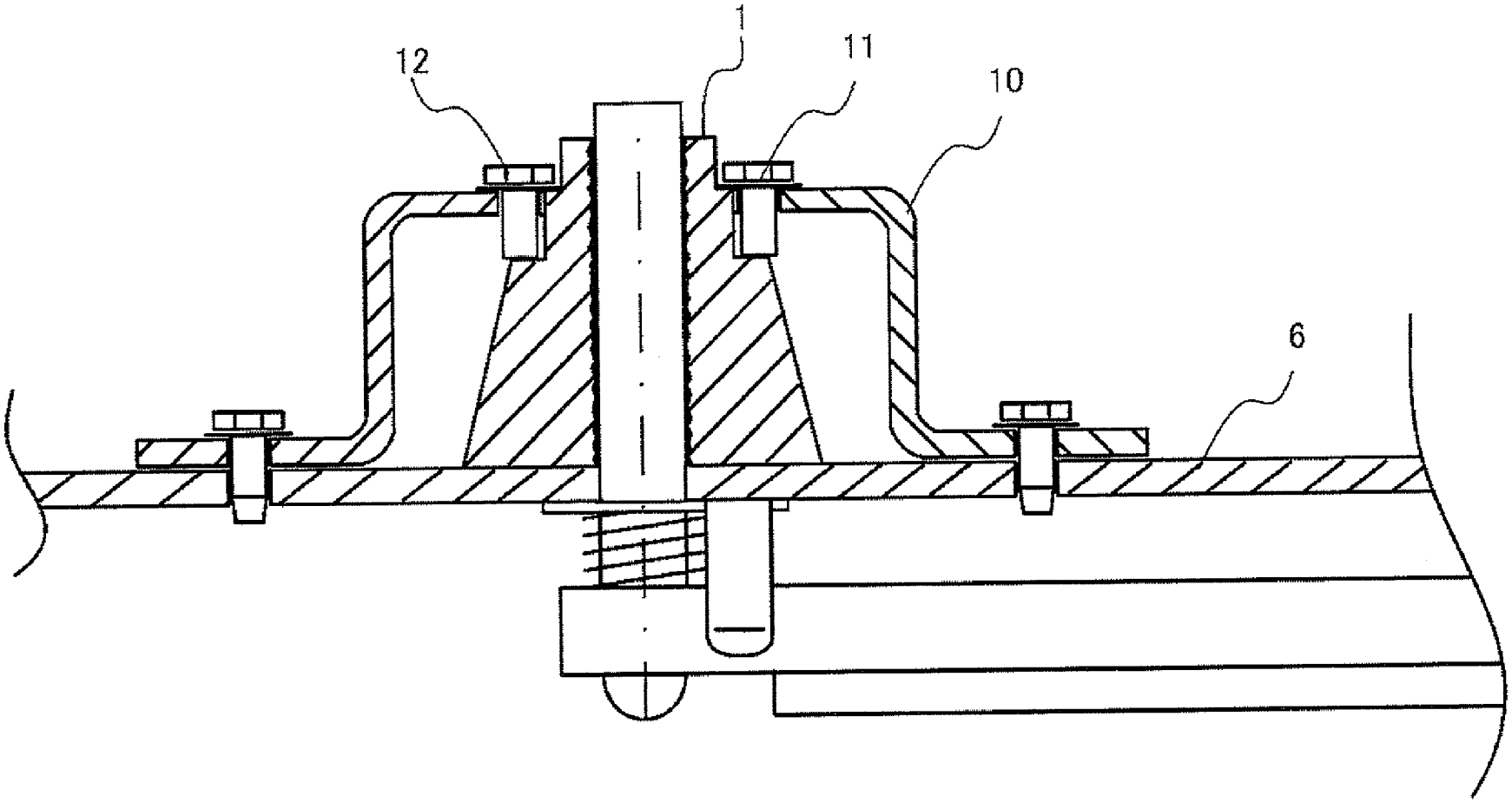
FIG. 5 is a schematic diagram showing the special nut 1 fixed by a nut-fixing member 10.

FIG. 5 is a schematic view showing the special nut 1 fixed to the housing 6 by a nut-fixing member 10.

As shown in FIG. 5, the special nut 1 is fixed to the housing 6 with the nut-fixing member 10; screws 11, 12 are screwed from round threaded holes formed in the nut-fixing member 10; and the special nut 1 is blocked from rotating by the screwed screws 11, 12. By blocking the special nut 1 from rotating, the result of the focus adjustment of the LPH (5) is fixed.

As described above, by blocking the special nut 1 from rotating after the focus adjustment, the adjustment result is fixed. Alternatively, the adjustment result may be maintained by fixing the special nut 1 to the housing 6 with an adhesive.

Additionally, the image formation device 50 may be configured such that plural LPHs are fixed to the housing by using the special nut 1 for attaching the LPH (5) to the housing 6, the plate spring 2, the coil spring 3, the nut fixing member 4, the plate spring 9, the nut-fixing member 10, the screw 11, the screw 12, etc.

Figures 6A, 6B:
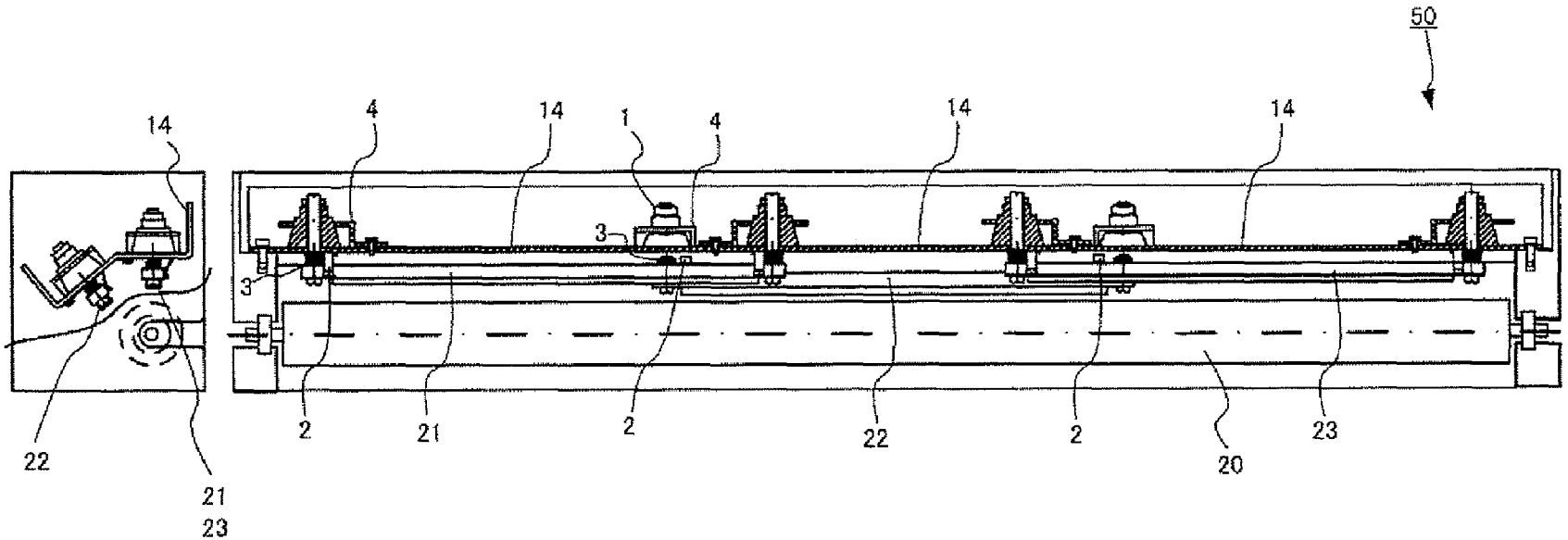
FIGS. 6A and 6B are schematic diagrams showing a state where plural exposure heads are fixed to a housing 14.

With reference to FIGS. 6A and 6B, a description will be made of a case where plural exposure heads are fixed to the housing.

FIGS. 6A and 6B are schematic views showing a state where plural exposure heads are fixed to a housing 14.

FIG. 6A is a configuration diagram showing a side view in which plural exposure heads are fixed to the housing 14, and FIG. 6B is a configuration diagram showing a front view in which plural exposure heads are fixed to the housing 14.

As shown in FIGS. 6A and 6B, three exposure heads are arranged and fixed to the housing 14 such that each of the exposure heads is shifted in a longitudinal direction. As a result, the exposure width becomes wider as compared with the case of the single exposure head. The special nut 1, the plate spring 2, the coil spring 3, and the nut fixing member 4 are used for attaching the exposure heads to the housing 14. Three exposure heads including an LPH1 (21), an LPH2 (22), and an LPH3 (23) are fixed to the housing 14. A photoreceptor 20 having a wide width is placed to the housing 14 to cover the wide exposure width.

Additionally, as shown in FIG. 6A, the LPH1 (21), the LPH2 (22), and the LPH3 (23) are attached to the housing 14 such that each adjacent exposure head is shiftedly arranged in a rotation direction of the photoreceptors so as not to interfere with each other. The method of fixing to the housing 14 is common to the three exposure heads, and the special nut 1, the plate spring 2, the coil spring 3, and the nut fixing member 4 are used. Additionally, the plate spring 9 may be used.

Since the photoreceptor 20 is located immediately below the LPH1 (21), the LPH2 (22), and the LPH3 (23) fixed to the housing 14 in the exposing direction, each of the exposure heads is fixed on the housing 14 so as not to protrude further out than the focusing point toward the side of the photoreceptor 20.

The present invention is applicable to the image formation device.

The foregoing description of the exemplary embodiment of the present invention is provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image formation device, comprising:

an exposure head in which a screw having an axis directed to a focus direction for a photoreceptor is fixed in the vicinity of each side of the exposure head;

a housing to which the exposure head is attached;

a nut attached to the screw;

a fixing member attached to a side of a nut attaching face, that allows the nut to rotate on the screw and engages with the nut by being pushed to the side of the nut attaching face to support the nut in the focus direction, and that limits movement of the nut with respect to the housing in a main-scanning direction and a sub-scanning direction of the photoreceptor together with the screw; and an elastic member that is attached by inserting the screw in the elastic member between the housing and the exposure head, and elastically supports the exposure head against the housing in the vicinity of the screw in the focus direction for the photoreceptor and the sub-scanning direction, wherein the exposure head is moved, by rotation of the nut, in the focus direction against an elastic force by the elastic member, and a position of the exposure head with respect to the photoreceptor is adjustable in the focus direction.

2. The image formation device according to claim 1, wherein the nut has a sloped portion conically sloped with respect to a rotation axis of the nut, the fixing member has a hole portion that limits movement of the nut by being fitted to the sloped portion of the nut, and comprises a plate spring fixed to the housing.

3. The image formation device according to claim 1, wherein the screw has a two-step structure including a straightly-shaped section formed in a portion to be engaged with the housing, and a male-thread-shaped section formed in a portion to be engaged with the nut, and the nut has a two-step structure including a female-thread section to be engaged with the male-thread-shaped section of the screw, and a large-diameter section having a diameter larger than the female-thread section.

4. The image formation device according to claim 1, wherein the elastic member has a coil spring that elastically supports the exposure head in the focus direction, and a plate spring that elastically supports the exposure head in the sub-scanning direction.

5. The image formation device according to claim 1, wherein the elastic member is a plate spring in which a first spring section that elastically supports the exposure head in the focus direction and a second spring section that elastically supports the exposure head in the sub-scanning direction are integrally formed.

6. The image formation device according to claim 1, wherein the housing is contacted to a surface of the photoreceptor or both flank portions of the photoreceptor, and is detachably attached, and in attaching the housing, the position of the exposure head is adjusted with respect to the housing by rotating the nut in a manner in which the exposure head is not contacted with the surface of the photoreceptor.

* * * * *